United States Patent [19]

Lucey, Jr. et al.

[11] 4,174,666

[45] Nov. 20, 1979

[54] SPRINGLESS IMPACT SWITCH

[75] Inventors: George K. Lucey, Jr., Greenbelt, Md.; Michael G. Orrell, San Antonio, Tex.

[73] Assignee: The United States of America as represented by the Secretary of the Army, Washington, D.C.

[21] Appl. No.: 901,885

[22] Filed: May 1, 1978

[51] Int. Cl.[2] ..... F42C 19/06

[52] U.S. Cl. ..... 102/216; 102/262; 200/61.45 R

[58] Field of Search ..... 102/216, 262, 237, 239, 102/241, 243, 245, 19.2; 200/61.45 R, 61.46, 80 R, 80 B

[56] References Cited

U.S. PATENT DOCUMENTS

| | | | |
|---|---|---|---|
| 419,143 | 1/1890 | Driggs | 102/241 |
| 2,685,008 | 7/1954 | Darnell | 102/262 |
| 2,938,461 | 5/1960 | Rabinow | 102/216 |
| 2,972,026 | 2/1961 | Kendall | 102/216 |
| 3,685,452 | 8/1972 | Held | 102/216 |
| 3,715,985 | 2/1973 | Fugelso | 102/216 |
| 3,726,227 | 4/1973 | Wagnecz | 102/262 |
| 3,771,457 | 11/1973 | Buxton | 102/262 |
| 3,899,649 | 8/1975 | Jenkins | 102/19.2 |

FOREIGN PATENT DOCUMENTS

| | | | |
|---|---|---|---|
| 1905636 | 8/1970 | Fed. Rep. of Germany | 102/216 |
| 2217030 | 11/1972 | Fed. Rep. of Germany | 102/216 |

*Primary Examiner*—Charles T. Jordan

*Attorney, Agent, or Firm*—Nathan Edelberg; Robert P. Gibson; Saul Elbaum

[57] ABSTRACT

An inertial impact switch is provided having a housing which comprises two conductive sections electrically insulated from each other and a movable contact member engaging one section and held out of contact with the second section by means of a concentric insulating member. Interior radial "fingers" of the insulator bend in response to the spin forces of the projectile containing the switch. To provide for this sensitivity, the fingers of the insulator may have varying stiffness to provide deflection under differing spin conditions. The body of the switch may also be provided with a single grove bellows that is compressible under applied stress prior to use, moving the first section of the housing closer to the second section of the housing, thus reducing the gap between terminals.

6 Claims, 6 Drawing Figures

SPRINGLESS IMPACT SWITCH

The invention described herein, may be manufactured, used and licensed by or for the government for governmental purposes without the payment to us of any royalty thereon.

BACKGROUND OF THE INVENTION

This invention relates to inertial impact switches that are normally in an open non-conductive position, whereby a first contact element is held in a spaced relationship to a second contact element by means of an insulating disc and is brought into closure contact in response to an impact or shock received by the switch. Switches for the uses disclosed herein may be of various mechanical and electrical means and are useful for making a projectile relatively safe to handle during its prelaunch phase, for arming the projectile or missile after it has left the launch vehicle and for disarming the projectile in the event that it should malfunction. The prior art has employed several devices that use various means of restraining the contact member. Representative prior art devices are shown by U.S. Pat. Nos. 419,143; 3,715,985; 3,726,227; and 3,899,649; and German Offenlegungsschrifts Nos. 1905636 and 2217030.

The prior art devices are generally less satisfactory than the present invention because of their greater complexity, larger numbers of parts and less universal application.

SUMMARY OF THE INVENTION

The present invention relates to a simple and relatively inexpensive springless inertial impact switch.

In accordance with the present invention, a housing comprising two sections, co-axial along a first axis, both of which are conductive but are electrically insulated from each other by means of insulators is provided. The first of said sections serves as a terminal and support for a co-axial movable contact element in conductive engagement with the first housing section and spaced from said second housing section, while said second section constitutes the second terminal element. The invention provides for an insulator disc within the housing, concentric to said movable contact element and having a reduced inside diameter opening and radial slots separating the fingers of the insulator. During handling and the early portions of flight, the fingers of the insulator prevent the movable contact element from establishing electrical contact between the first and second sections of the housing. The insulating disc may be positioned as shown or may be located anywhere within the housing concentric to the movable contact element. During flight on a spinning projectile, forces along the axis of the housing unlock the moveable element by causing the fingers of the insulating disc to bend away from said element. The stiffness of the fingers may be designed for total collapse at any desired spin force. The buckling resistance of the fingers defines the inflight and impact sensitivities of the switch. The usual spin of projectiles of military interest are in the range of about 50 Hz to about 300 Hz. Accordingly, it is possible to design switches to this invention that have total finger collapse at 50 Hz.

In projectiles having little or no spin, the fingers hold the movable contact element in a non-conductive position during flight. Upon impact, the fingers buckle and allow contact between the movable element and the housing sections.

Another aspect of this invention is to provide an impact switch having a means of adjusting the switch sensitivity. This aspect of the invention is accomplished by providing a means to alter the size of the gap between the movable contact element and the housing sections.

For military applications, switch cost, production and reliability are of great importance. A major contributors to switch cost is the spring employed in the prior art devices and the related assembly problems. These problems can be overcome by using the switch of the present invention.

BRIEF DESCRIPTION OF THE DRAWINGS

For a more complete understanding of the invention references should be had to the following descriptions and the accompanying drawings in which.

DESCRIPTION OF THE PREFERRED EMBODIMENTS

The present invention is concerned with a switch used to sense target impact in various fuze types. The structure of the switch must be such as to insure that the contacts are in the open non-conductive position during production and handling of the projectile. This specifically designed feature is required for fuze reliability during flight and to perform electrical acceptance tests of fuzes during production. Moreover the function of the switch is to provide a base line sensitivity to closure that is acceptable for a wide variety of spin and nonspin applications, such as, mortar shells, rockets, bombs, and other artillery projectiles.

Figure 1:
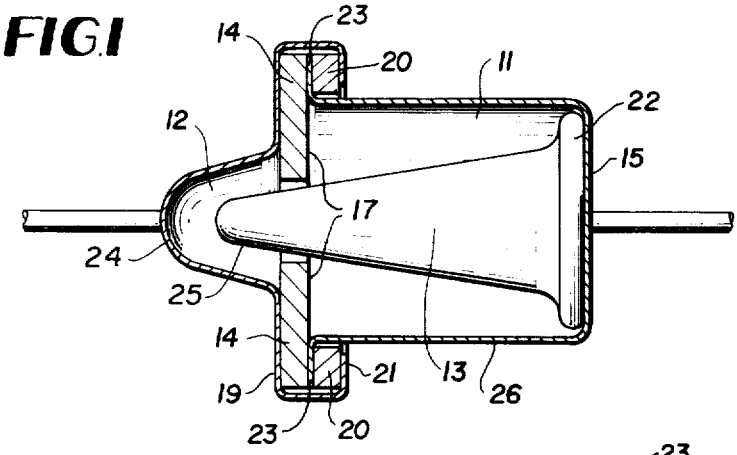
FIG. 1 is a cross-sectional view of an impact switch constructed in accordance with the invention.

Referring now to FIG. 1, the switch includes a housing which comprises two sections, 11 and 12, both of which are electrically conductive but are competely insulated from each other. The first section of the housing 11 serves as the base support and contact terminal for movable contact element 13 while section 12 of the housing constitutes a second contact terminal. According to the present invention, the movable contact element 13 is maintained in the open or nonconductive position with housing section 12 by insulator 14.

Figure 2:
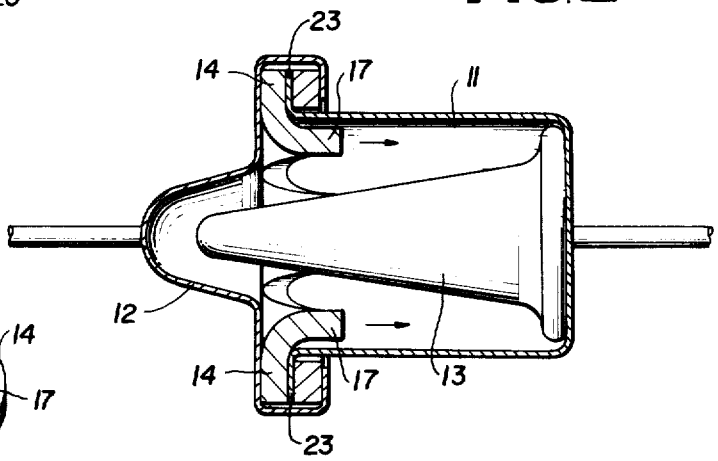
FIG. 2 is a cross-sectional view of an impact switch in accordance with the invention wherein the fingers of the insulator are deflected by spin forces to allow movement of the contact element.
Figure 3:
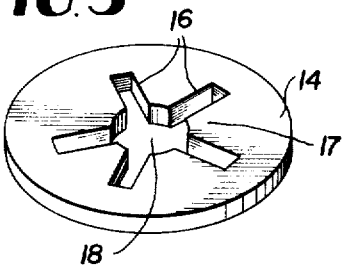
FIG. 3 is a perspective view of an insulator employed in the present invention.

FIG. 2 illustrates the switch of FIG. 1 after being subject to the forces necessary to unlock the movable contact element by bending the fingers on the insulator. FIG. 3 shows the insulator 14 of the present invention comprising a reduced inside diameter opening 18 and radial slots 16 separating fingers 17.

Figure 4:
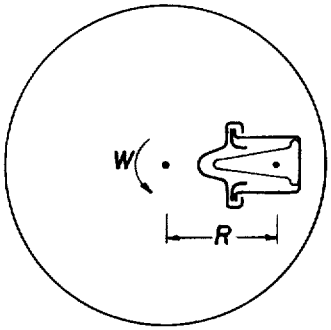
FIG. 4 is a top view schematic representation of a switch of the present invention mounted on a fuze.

FIG. 4 illustrates a top view of a fuze with an eccentrically mounted switch of the present invention. The centrifugal forces that bend the fingers to the open position also hold the contact element in the normally open position, thereby performing the function of a spring. The stiffness of the insulators fingers depends upon the radial position of the switch within the fuze "R" and the square of the spin "W". If the switch is mounted on a fuze which is not employed on a spinning projectile, the fingers hold the contact element in its normally open position during flight. The strength of the fingers define the inflight and impact sensitivity of the switch. At low projectile spin, the deflection of the fingers will be small and the resistance to contact closure greatest. At higher spin values, the deflection of the fingers increases and the point of contact within the switch housing lowers.

Figure 5:
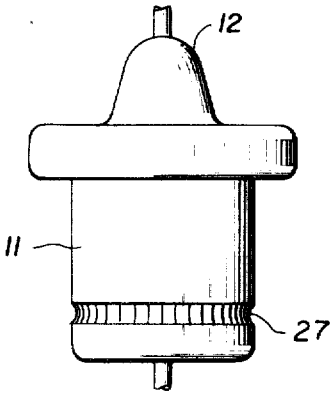
FIG. 5 is a cross-sectional view of a switch constructed according to the present invention wherein the housing has been adapted to provide a groove bellows as means of adjusting the switch sensitivity.
Figure 6:
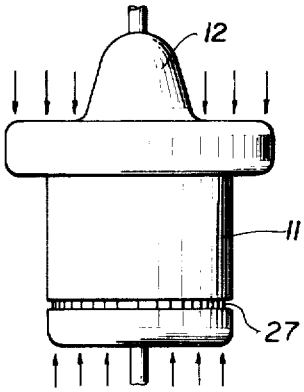
FIG. 6 is a cross-sectional view of the switch of FIG. 5 showing the bellows collapsed to reduce the gap between the switch contacts.

FIG. 5 shows a switch housing comprising sections 11 and 12. Section 11 of the housing contains grooves 27 such that the body of the switch housing is shaped as a bellows. The grooves are formed in such a manner so as to avoid cracking of the housing when compressed, thereby maintaining the switch seal; are compressable under an axial load that will not damage other components within the switch; provide restorable or permanent adjustments depending upon the switch application; and avoid interference with the contact element. FIG. 6 shows a switch housing after the bellows 27 as shown in FIG. 5 have been compressed.

Various means may be employed for forming the grooves in the housing shown in FIG. 5. For example, crimping or rolling may be used on switches that have been assembled without grooves in the body. Grooves formed on the housing prior to the switch assembly may be formed by reducing the thickness of the wall. This procedure prevents distorting the inside diameter and avoids interference with the contact element during assembly of the switch.

Preferrably, the switch of the present invention comprises a first section 11 having a bottom wall 15 and side walls 26 with an outward flange 23. The second section 12 of the switch housing has a central dome shape portion 24 projecting from the body portion. An electrically insulating disc 14 is interposed between flange 23 and body portion 19 of section 12 of the housing. Another electrically insulating disc 20 is interposed between flange 23 of housing section 11 and inturned edge portion 21 of section 12 of the housing. The insulating materials 14 and 20 provide for mechanical contact between housing sections 11 and 12 while providing no electrical contact. The movable contact element shown in FIGS. 1 and 2 comprises a hollow cone having an outwardly extending flange 22 at its base portion where it seats to section 11 of the switch housing. The apex of the cone 25 extends into the dome shape portion 24 of section 12 of the switch housing and is normally in a spaced relationship thereto. During handling of the switch or device containing the switch, there should be no jamming of the contact between the fingers of the insulator or failure of the insulator material due to fatigue or inelastic stresses. During flight on a spinning projectile the fingers must deflect a prescribed distance from the contact.

If the switch is mounted on a fuze that is not used on a spinning projectile, the fingers hold the contact element in its normally oepn non-conductive position during flight. The buckling strength of the fingers define the inflight and impact sensitivities of the switch. Upon impact of the projectile, the contact element 13 makes electrical contact between sections 11 and 12 of the switch housing. This contact is permitted by either the weight of the contact element bending the fingers or by the buckling of the fingers due to the impact of the projectile when it comes to rest.

The contact element of the switch may be mounted on the projectile at any angle within 180 degrees from perpendicular to the nose of the projectile to parallel with the projectile with the movable contact element pointing toward the nose.

The switches provided by the present invention are idealy suited for military applications since they are of small size, low cost, useful on spin and non-spin projectiles, amenable to thick film and conventional circuitry, resistant to in-flight vibrations due to internal damping, resistant to the deterimental effects of off center spin, and amenable to different directions of mounting due to hemispherical impact sensitivity.

In the switches of the prior art, the sensitivity of the switch is fixed once assembly is completed, and to change the sensitivity of a switch requires modification in production tooling and/or fabrication of various switch components. In the preferred embodiment of the present invention, there is provided a means of adjusting the switch sensitivity. This feature is accomplished by altering the size of the gap between the switch contacts by compressing the bellows, thus bring the contact terminals closer together. Thus, one switch design may be used in a variety of fuze applications.

We wish it to be understood that we do not desire to be limited to the exact detail of construction shown and described for obvious modifications will occur to persons skilled in the art.

What is claim:

1. A springless impact switch comprising:
   - a housing including a first and a second conductive section co-axial along a first axis and being electrically insulated from each other;
   - a co-axial movable contact element in conductive engagement with the first housing section and normally spaced from said second housing sections;
   - and an insulator disc interior said housing, concentric to said movable contact element and having a reduced inside diameter opening and radial slots defining fingers of the insulator, said fingers being deflectable by forces parallel to said axis to permit the contact element to establish electrical conductivity between said first housing section and said second housing section.

2. An impact switch of claim 1 wherein the fingers of the insulator disc collapse under centrifugal force within a spin range of about 50 to about 300 Hz.

3. An impact switch of claim 2 wherein the fingers of the insulator disc collapse under centrifugal force at a spin of about 50 Hz.

4. The impact switch of claim 1 wherein the first housing section is grooved to provide a means of altering the gap between the switch terminals.

5. An impact switch of claim 1 wherein said contact element is responsive to axial and transverse axial forces to allow contact between said housing sections.

6. A springless impact switch comprising:
   - a housing including a first and a second conductive section, said sections being electrically insulated from each other;
   - a movable contact element normally in conductant engagement with the first housing section;
   - and means for maintaining the moveable contact element in non-contact with the second housing section, said means being removeable by centrifugal forces.

* * * * *